US005889813A

United States Patent [19]

Fujita et al.

[11] Patent Number: 5,889,813

[45] Date of Patent: Mar. 30, 1999

[54] LEVITATION MELTING FURNACE

[75] Inventors: Michiru Fujita; Tatsuo Take; Hideaki Tadano; Kengo Kainuma; Masaki Sakuma, all of Kawasaki, Japan

[73] Assignee: Fuji Electric Co., Ltd, Kanagawa, Japan

[21] Appl. No.: 701,094

[22] Filed: Aug. 21, 1996

[30] Foreign Application Priority Data

Aug. 25, 1995 [JP] Japan ..... 7-216943

[51] Int. Cl.[6] ..... H05B 6/32

[52] U.S. Cl. ..... 373/156; 373/142; 373/155; 219/648

[58] Field of Search ..... 373/138–139, 373/155–157, 71, 72, 76, 116–122, 142; 219/648

[56] References Cited

U.S. PATENT DOCUMENTS

| | | | |
|---|---|---|---|
| 3,582,528 | 6/1971 | Seale et al. | 373/139 |
| 5,058,127 | 10/1991 | Garnier et al. | 373/157 |
| 5,109,389 | 4/1992 | Stenzel | 373/156 |

FOREIGN PATENT DOCUMENTS 7-249483 9/1995 Japan .

*Primary Examiner*—Tu Ba Hoang
*Attorney, Agent, or Firm*—Pearne, Gordon, McCoy & Granger LLP

[57] ABSTRACT

A cooling water conduit extending through a segment of a crucible is curved inward in the portion around a molten metal tapping hole.

10 Claims, 5 Drawing Sheets

INDUCTION CURRENT DISTRIBUTION ON A CRUCIBLE

INDUCTION CURRENT DISTRIBUTION ON A MELT

DISTRIBUTION OF FORCE EXERTED TO A MELT

LEVITATION MELTING FURNACE

BACKGROUND OF THE INVENTION

The present invention relates to a levitation melting furnace which melts electrically conductive material by inductively heating the conductive material placed in an alternating magnetic field, the distribution thereof is adjusted to generate such electromagnetic force as to float the conductive material.

FIG. 4 is a cross sectional perspective view of a conventional levitation melting furnace. Referring now to FIG. 4, a cylindrical crucible 1 includes an electrically conductive metal segments 11, each having a cooling water conduit 4, and insulation layers 12 which insulate the adjoining segments 11 from each other. The segments and insulation layers are laminated one after the other to form the side and bottom of the cylindrical crucible 1. The molten metal can be tapped from a hole 5 of bottom of a crucible through the conduit 6. The hole diameter of the conduit 6 is larger than the diameter of the hole 5. An upper induction coil 2 is wound around the upper part of the crucible 1 for melting the metal in the crucible and for exerting electromagnetic force horizontally to a molten metal 8 to stabilize the floated molten metal 8. A lower induction coil 3 exerts levitational force strong enough to float the molten metal 8. The levitation melting furnace of FIG. 4, which pinches the diameter of the tapping hole 5 and expands the hole diameter of the tapping conduit 6 to exert the levitational force to the molten metal 8 by the lower induction coil 3, is disclosed in the Japanese Unexamined Patent Publication No. Hei. 7-249483.

FIG. 5 shows the external appearance of the conventional segment 11. Referring now to FIG. 5, the cooling water conduit 4 is inserted into the segment 11. Both ends of the cooling water conduit 4 are connected to respective cooling water feed pipes 9. The cooling water feed pipe 9 has a spigot joint 10 at an end thereof. As shown in FIG. 5, there remains no choice but to insert the induction coils upward from the bottom of the crucible due to the diameter differences between the crucible and induction coils. And, it is difficult to connect the cooling water feed pipes 9 beneath the segment 11 due to the space limitations. Therefore, the cooling water feed pipes 9 and the spigot joints 10 are aligned at first on the extensions of the segment 11. Then, the cooling water feed pipes 9 are bent outward and connected to the cooling water piping after the upper and lower induction coils 2 and 3 are mounted on the side of the crucible 1.

FIG. 6A is an induced current distribution on the crucible 1, FIG. 6B an induced current distribution on the molten metal 8, and FIG. 6C a distribution of force exerted to the molten metal 8, which are obtained by energizing the lower induction coil 3 of the levitation melting furnace which exerts levitational force to the molten metal by means of the narrowed diameter of the tapping hole 5 and the expanded diameter of the tapping conduit 6. In these figures, the symbols ○ and □ represent the induced currents flowing in opposite directions to each other in the crucible 1 and molten metal 8. The magnitudes of the current are indicated in proportion to the size of the symbols. The magnitudes of the force exerted to the molten metal 8 are indicated by the length of the arrows in FIG. 6C.

Since the currents flow in the opposite directions in the molten metal 8 and the crucible 1 surrounding the molten metal 8, repulsive electromagnetic force is exerted between the molten metal 8 and the crucible 1. When the repulsive electromagnetic force exceeds the gravitational force, the molten metal 8 is not tapped through the tapping hole 5. When the electromagnetic force around the tapping hole 5 is not so strong as to sustain the weight of the molten metal 8, the molten metal 8 is tapped through the tapping hole 5.

In the conventional levitation melting furnace which narrows the diameter of the tapping hole 8, the induced current is localized on the surface of the tapping hole, and the current induced in the molten metal 8 becomes larger toward the bottom of the molten metal 8. Therefore, strong force is exerted to the bottom of the molten metal 8. The levitational force exerted to the bottom of the molten metal 8 is 4 to 5 times as large as the levitational force generated by the lower induction coil 3, located around the tapping hole 5 having the diameter same with the hole diameter of the tapping conduit 6 and energized with the same current value. Therefore, sufficient levitational force is exerted to the molten metal 8 in spite of the reduced current feed to the lower induction coil 3.

The crucible 1 generates heat by the current induced therein by the upper and lower induction coils 2 and 3. The heat radiated from the molten metal to the crucible is carried away by the cooling water flowing through the cooling water conduits 4 in the segments 11.

In the above described conventional furnace, when the electric power fed to the upper induction coil and/or the lower induction coil is increased to improve the productivity by enlarging the furnace capacity or by shortening the melting period of time, the adjacent portion of the molten metal tapping hole is overheated, since the currents, induced in the crucible by the upper and lower induction coils and concentrating around the molten metal tapping hole, increase. Therefore, the maximum electric power fed to the upper induction coil and/or the lower induction coil is limited.

If the electric power fed to the lower induction coil is limited to suppress the overheating around the molten metal tapping hole, sufficient levitational force may not be obtained when the furnace capacity is enlarged.

For suppressing the overheating around the molten metal tapping hole by the conventional cooling scheme, it is necessary to expand the diameter of the cooling water conduit. Then, it becomes necessary to elongate the circumferential length of the segment to expand the diameter of the cooling water conduit without changing the relative spacing between the upper induction coil and the molten metal. However, since the elongated circumferential length of the segment reduces the levitational force exerted to the entire molten metal, it becomes difficult to lift the molten metal.

The method for preventing overheat by increasing the flow rate of the cooling water subjects to the other problems, since the pressure loss of the cooling water is proportional to the square of the flow rate of the cooling water and since the flow rate of the cooling water in these kinds of furnaces has been already from 13 to 15 m/sec which brings the pressure loss at the cooling water inlet of the furnace to limit thereof.

It takes time to replace the upper and lower induction coils, since it is necessary to heat and bend back the cooling water feed pipes prior to disengaging the induction coils.

SUMMARY OF THE INVENTION

In view of the foregoing, it is an object of the invention to provide a levitation melting furnace which facilitates cooling the portion around the molten metal tapping hole to increase the electric power fed to the upper and lower induction coils. It is another object of the invention to provide a levitation melting furnace which facilitates quickly melting a large amount of molten metal. It is still another objects of the invention to provide a levitation melting furnace which facilitates replacing the upper and lower induction coils.

According to the present invention, there is provided a levitation melting furnace which comprises:

a crucible including;

a cylindrical side wall formed by electrically conductive metal segments which respectively have a cooling fluid conduit for conducting cooling fluid extending through the longitudinal direction thereof and are laminated one after the other through insulating layers, and a bottom having a molten metal tapping hole for tapping molten metal and a molten metal tapping conduit continuous to the molten metal tapping hole, an inner diameter of the molten metal tapping conduit being larger than a diameter of the molten metal tapping hole;

an upper induction coil surrounding the cylindrical side wall of the crucible; and a lower induction coil surrounding the molten metal tapping conduit of the crucible, wherein the cooling fluid conduit includes a curved section bent inward around the molten metal tapping hole.

Advantageously, the curved section comprises a trench dug from outside and a plug inserted from outside to the trench for tightly closing the trench.

Advantageously, the distal end of the plug is positioned more inwardly than the cooling fluid conduit around the molten metal tapping conduit.

Advantageously, the plug comprises:

an electrically conductive metal, and a wear resistive layer formed on a contact surface with the cooling fluid of the electrically conductive metal. Preferably, the wear resistive layer may be a ceramic layer thermally sprayed on the contact face, or a metal layer adhered or bonded to the contact face, the metal layer being more resistive against wear than the electrically conductive metal.

Advantageously, the cooling fluid conduit has an outlet of which section area is larger than that of an inlet at the curved section.

Advantageously, the levitation melting furnace of the invention further comprises:

a side hole bored from outside to the cooling fluid conduit on a lower end portion of each segment;

a groove for housing an O-ring, the groove being disposed around the side hole; and a late mount cooling pipe for feeding or for exhausting the cooling fluid to or from the cooling fluid conduit; the late mount cooling pipe being fixed to the segment, whereby to form a cooling fluid circuit after the upper and lower induction coils are installed on the crucible.

Advantageously, the levitation melting furnace of the invention further comprises:

a side hole bored from outside to the cooling fluid conduit on an upper end portion of each segment;

a groove for housing an O-ring, the groove being disposed around the side hole; and a late mount cooling pipe for feeding or for exhausting the cooling fluid to or from the cooling fluid conduit, the late mount cooling pipe being fixed to the segment, whereby to form a cooling fluid circuit after the upper and lower induction coils are installed on the crucible.

The portion of the segment corresponding to the molten metal tapping hole is protruding toward the molten metal tapping hole. A trench is dug from outside in the portion of the segment corresponding to the molten metal tapping hole, and the trench is closed with a trapezoidal plug such that the distal end of the plug is positioned further inside the cooling fluid conduit. Thus, by curving the cooling fluid conduit inward to the molten metal tapping hole, the thermal conduction distance between the cooling fluid conduit and the molten metal tapping hole is shortened. By positioning the distal end of the plug further inside the cooling fluid conduit, the cooling fluid is prevented from stagnating in the curved section of the cooling fluid conduit.

By narrowing the cross section of the cooling fluid conduit in the upstream portion of the curved section and widening the cross section of the cooling fluid conduit in the downstream portion of the curved section, turbulent flow is enhanced in the downstream portion, and thermal conduction in the portion of the segment around the molten metal tapping hole is further improved.

Since the portion of the plug protruding to the cooling fluid conduit is hardly heated inductively due to the skin effect, the plug is prevented from wearing due to the sands and such occlusions in the cooling fluid by providing more hardness to the protruding portion of the plug more than that of the electrically conductive metal (copper) of the plug.

The late mount cooling pipe, fixed easily with screws to the segment with an O-ring sandwiched in-between, is also detachable easily.

DETAILED DESCRIPTION OF THE PREFERRED EMBODIMENTS

Now the present invention will be explained hereinafter with reference to the accompanied drawing figures which illustrate the preferred embodiments of the invention.

Figure 1:
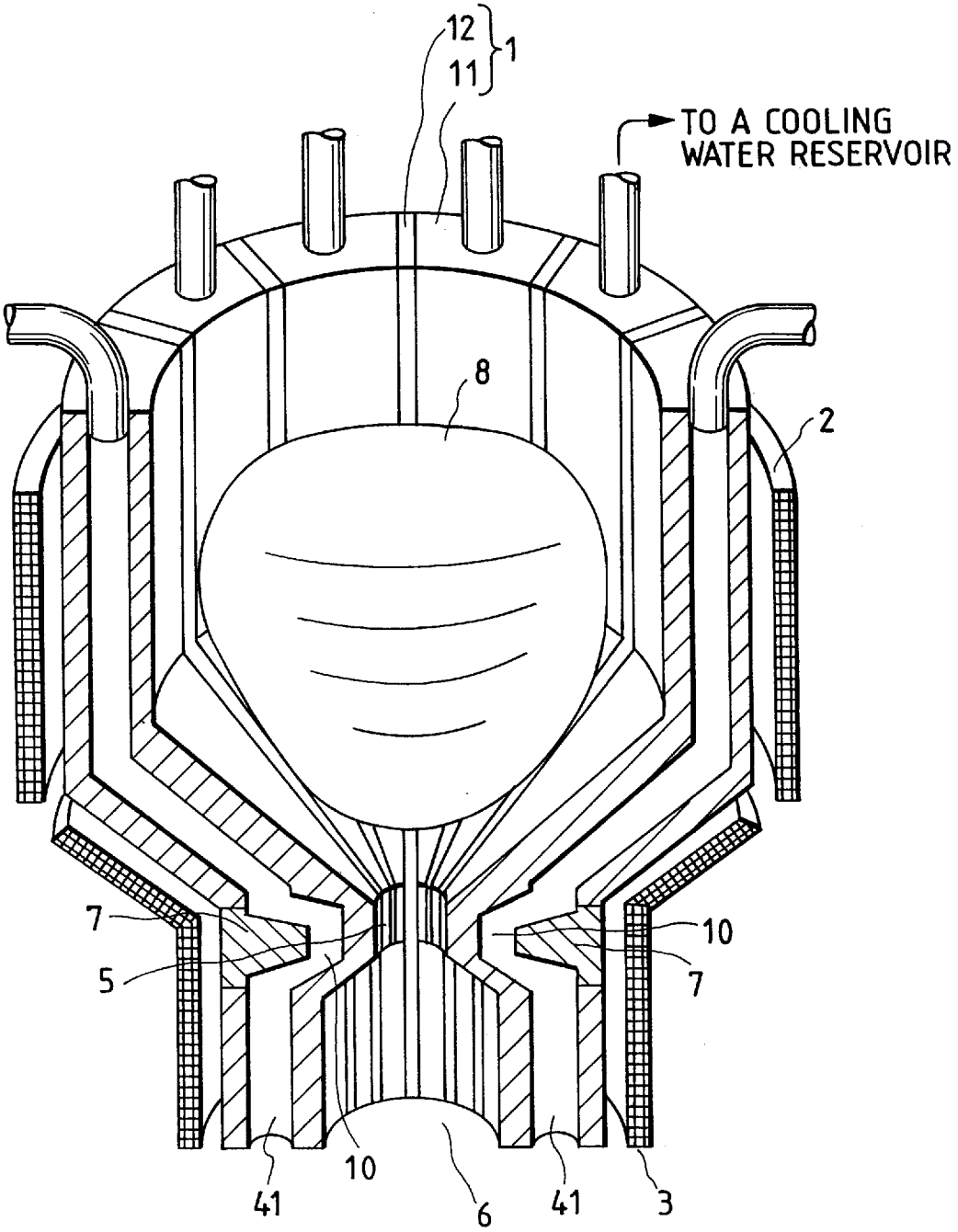
FIG. 1 is a cross sectional perspective view of a first embodiment of a levitation melting furnace according to the invention.

FIG. 1 is a cross sectional perspective view of a first embodiment of a levitation melting furnace according to the invention. In FIG. 1, the like parts with those of the conventional levitation melting furnace are designated by the like reference numerals and their explanations are omitted for the sake of simplicity.

Referring now to FIG. 1, a cylindrical crucible 1 includes an electrically conductive metal segments 11, each having a cooling water conduit 41 extending along the length direction thereof, and insulation layers 12 which insulate the adjoining segments 11 from each other. The segments 11 and insulation layers 12 are laminated one after the other to form the side and bottom of the cylindrical crucible 1. The bottom of the crucible 1 includes a molten metal tapping hole 5 and a molten metal tapping conduit 6 communicating with the tapping hole 5. The hole diameter of the conduit 6 is larger than the diameter of the hole 5. An upper induction coil 2 is wound around the upper part of the crucible 1 for melting the metal in the crucible and for exerting electromagnetic force horizontally to a molten metal 8 to stabilize the floated molten metal 8. A lower induction coil 3 exerts levitational force strong enough to float the molten metal 8.

The cooling water conduit 41 has a curved section curved toward the molten metal tapping hole 5. The curved section includes a trench 10 dug from outside to the segment 11 and a trapezoidal plug 7 fused to tightly close the trench 10. The distal end of the plug 7 is positioned more inwardly than the cooling water conduit 41 around the molten metal tapping conduit 6 to curve the cooling water conduit 41 toward the molten metal tapping hole 5. It has been found experimentally that the temperature rise caused in the adjacent portion around the bottom of the crucible, where the molten metal tapping hole 5 continues to the bottom of the crucible, is 70° C. for the cooling water conduit 41 with the curved section shown in FIG. 1, while the temperature rise caused in the adjacent portion around the bottom of the crucible is 170° C. for the cooling water conduit 4 of the conventional furnace of FIG. 4 without the curved section. The comparison is made with the same electric power fed. By providing the cooling water conduit with the curved section, the electric power, fed to the lower induction coil 3 for generating levitational force and/or the upper induction coil 2 for melting may be increased until heat accumulates in the foregoing adjacent portion of the present furnace about 2.4 times as much as to the adjacent portion of the conventional crucible. The cooling water collides with the trapezoidal plug 7 with tremendous speed. To improve the wear resistance of the contact plane of the plug 7 with the cooling water, the electrically conductive metal plug is provided with a thermally sprayed ceramic layer or a highly wear resistive metal layer bonded or adhered.

Figure 4:
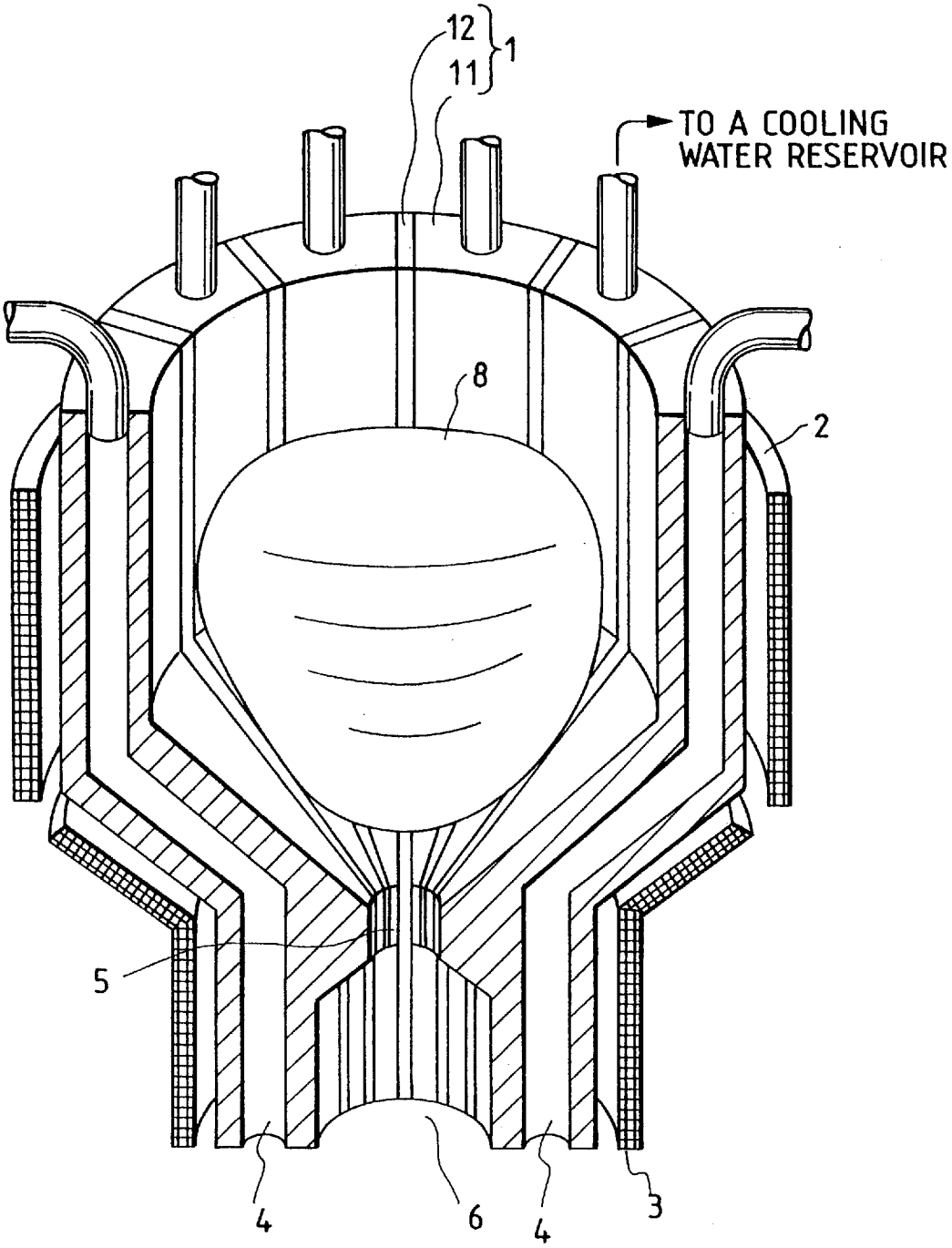
FIG. 4 PRIOR ART
FIG. 4 is a cross sectional perspective view of a conventional levitation melting furnace.
Figure 5:
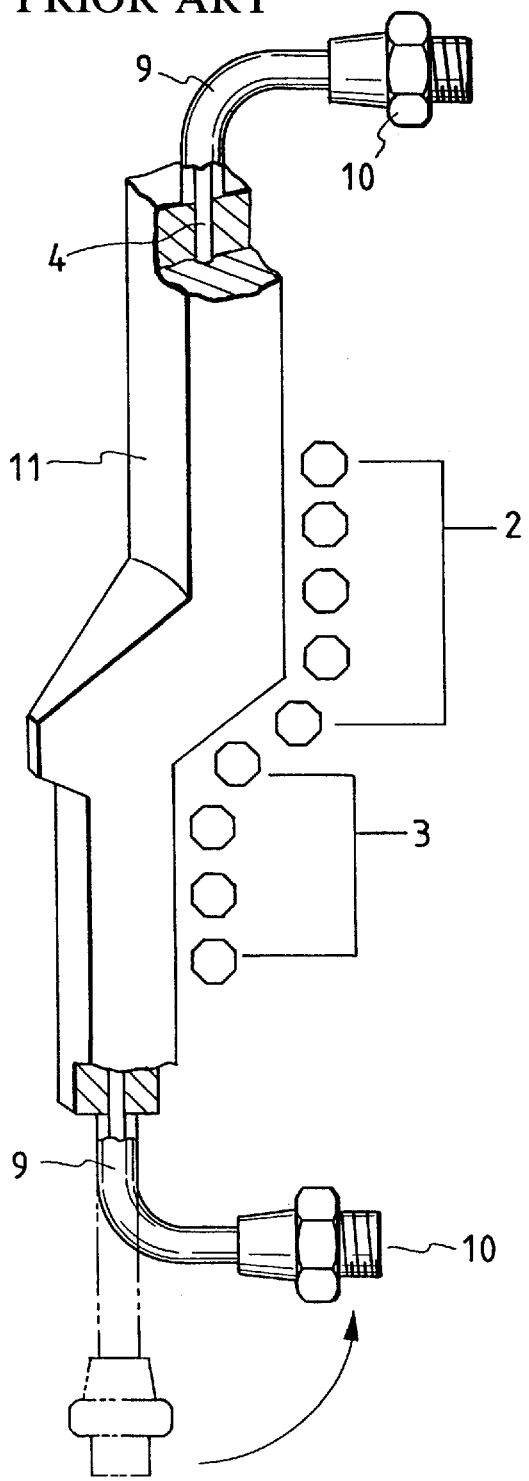
FIG. 5 PRIOR ART
FIG. 5 shows the external appearance of the segment of FIG. 4.
Figure 6A:
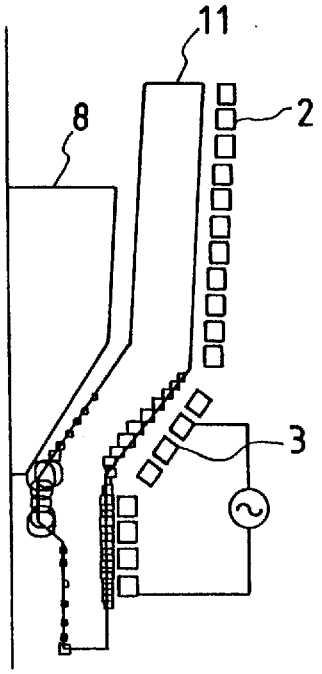
FIG. 6A PRIOR ART
FIG. 6A is an induced current distribution on the crucible.
Figure 6B:
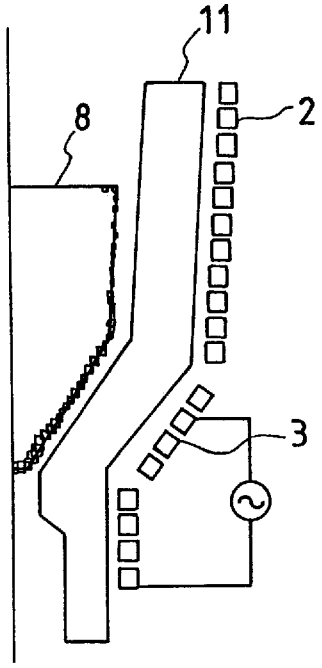
FIG. 6B PRIOR ART
FIG. 6B is an induced current distribution on the molten metal.
Figure 6C:
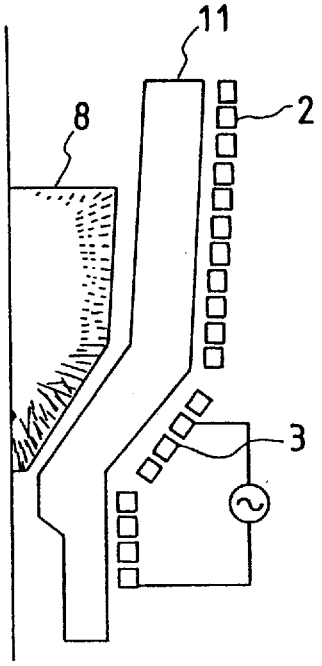
FIG. 6C PRIOR ART
FIG. 6C is a distribution of force exerted to the molten metal.

The levitation melting furnace of FIG. 1 pinches the diameter of the tapping hole 5 and expands the hole diameter of the tapping conduit 6 to exert large levitational force to the molten metal 8 by the lower induction coil 3 as the conventional levitation melting furnace of FIG. 4 does.

Figure 2:
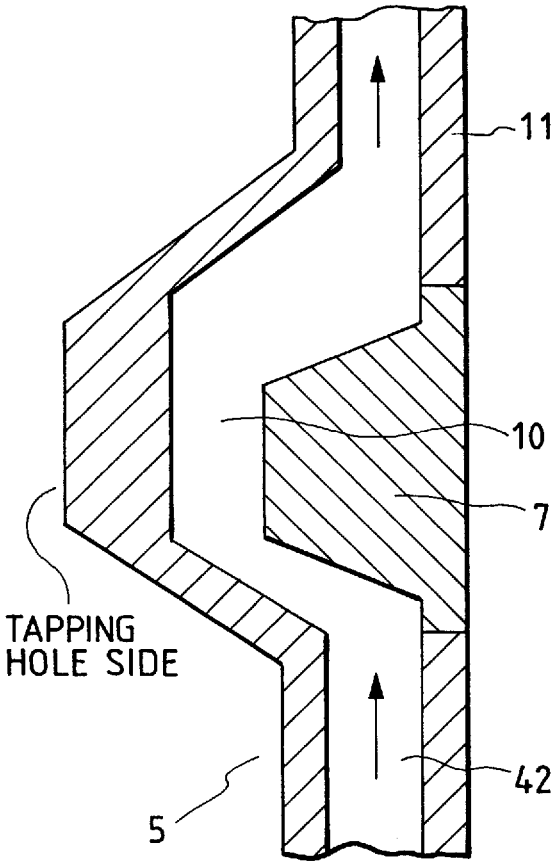
FIG. 2 is a cross section showing a main part of a second embodiment of a levitation melting furnace according the invention.

FIG. 2 is a cross section showing a main part of a second embodiment of a levitation melting furnace according the invention. Referring now to FIG. 2, a plug 7 is displaced toward the upstream side of the cooling water to widen the cross section of a cooling water conduit 42 in the downstream part of the curved section and to narrow the cross section of the duct 42 in the upstream part of the curved section. By varying the cross section of the curved section as described above, turbulent flow of the cooling water is caused in the downstream part of the curved section to enhance the heat conduction in the portion around the molten metal tapping hole 5. Arrows in the figure show the flow direction of the cooling water.

Figure 3:
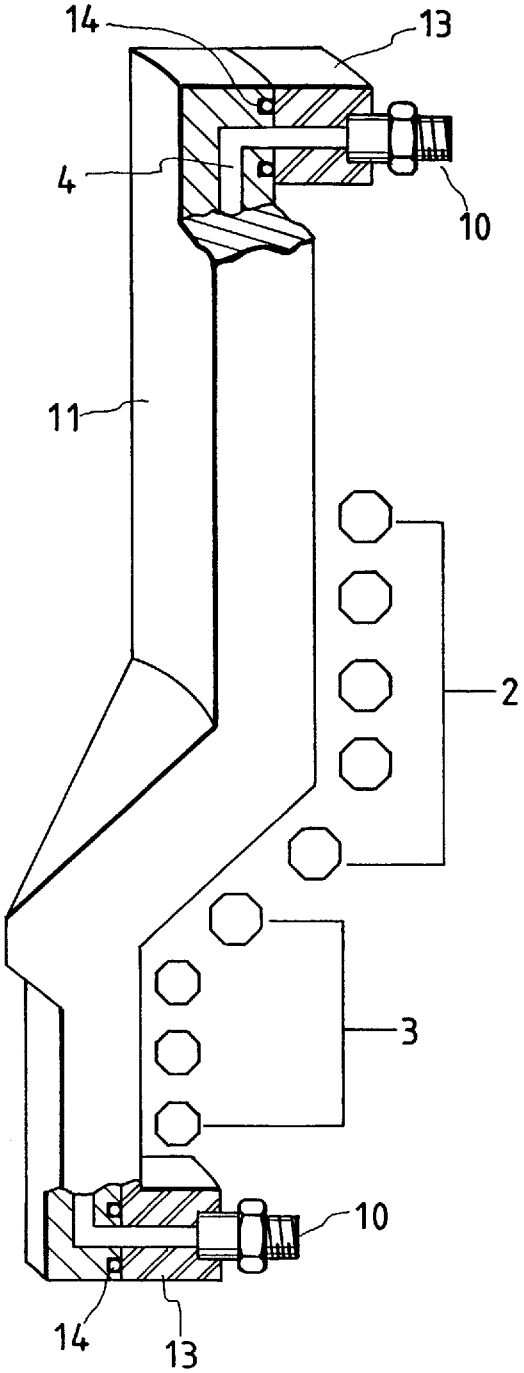
FIG. 3 is an external appearance of a segment as a main part of a third embodiment of a levitation melting furnace according the invention.

FIG. 3 is an external appearance of a segment as a main part of a third embodiment of a levitation melting furnace according the invention. Referring now to FIG. 3, side holes are bored from outside on the upper and lower ends of the segment 11 to the cooling water conduit 4. An O-ring groove 14 and a screw hole (not shown) for engaging a late mount cooling pipe 13 to be mounted later are formed around each side hole. An O-ring inserted in the groove 14 is pressed by the cooling pipe 13. A spigot joint 10 is mounted on the cooling pipe 13, and the spigot joint 10 is connected to the piping of the cooling water circuit. The late mount cooling pipe 13 is mounted on the segment 11 after the upper and lower induction coils 2 and 3 are installed on the crucible. The late mount cooling pipe 13 may be used only for the upper or the lower part of the segment 11. In this occasion, the lower or the upper part of the segment 11 may be formed as by the prior art.

The electric power fed to the upper induction coil is increased, according to the invention, by the enhanced cooling of the portion around the molten metal tapping hole. Due to the increased electric power feed, the furnace capacity is enlarged, the melting period of time is shortened and the productivity is improved. The late mount cooling pipe, easily screwed to the segment with an O-ring sandwiched in-between and easily detachable, shortens the replacing period of time for replacing the induction coils.

What is claimed is:

1. A levitation melting furnace comprising:

a crucible having a longitudinal axis and comprising an upper cylindrical side wall and a bottom, said side wall and bottom being formed by a plurality of electrically conductive metal segments and a plurality of insulating layers, one of said plurality of insulating layers being disposed between a pair of adjacent metal segments, each of said metal segments defining a cooling fluid conduit for conducting cooling fluid generally parallel to said longitudinal axis, said crucible bottom defining a molten metal tapping hole for tapping molten metal and a molten metal tapping conduit, said tapping conduit being in communication with said molten metal tapping hole, an inner diameter of said molten metal tapping conduit being larger than a diameter of said molten metal tapping hole;

an upper induction coil surrounding said upper cylindrical side wall of said crucible; and a lower induction coil surrounding said molten metal tapping conduit of said crucible bottom, wherein each cooling fluid conduit includes upper and lower sections and a curved section between said upper and lower sections, and said curved sections extend radially inwardly toward said longitudinal axis at said molten metal tapping hole and serve to cool said metal segments at said tapping hole.

2. The levitation melting furnace of claim 1, wherein said curved section comprises:

a trench extending from an exterior surface of said metal segment toward said tapping hole, said trench forming an exterior opening in said metal segment, and a plug inserted into said exterior opening for tightly closing said trench exterior opening.

3. The levitation melting furnace of claim 2, wherein a distal end of said plug is closer to said longitudinal axis than is said lower section of said cooling fluid conduit.

4. The levitation melting furnace of claim 2, wherein said plug comprises:

an electrically conductive metal, and a wear resistive layer formed on a contact surface of said electrically conductive metal which is contacted by cooling fluid.

5. The levitation melting furnace of claim 4, wherein said wear resistive layer comprises:

a ceramic layer thermally sprayed on said contact surface, said ceramic layer being more resistive against wear than said electrically conductive metal.

6. The levitation melting furnace of claim 4, wherein said wear resistive layer comprises:

a metal layer adhered to said contact surface, said metal layer being more resistive against wear than said electrically conductive metal.

7. The levitation melting furnace of claim 4, wherein said wear resistive layer comprises:

a metal layer bonded to said contact surface, said metal layer being more resistive against wear than said electrically conductive metal.

8. The levitation melting furnace of claim 2, wherein said cooling fluid conduit curved section has an inlet and an outlet, said curved section outlet having a cross-sectional area which is larger than that of said curved section inlet.

9. The levitation melting furnace of claim 1, further comprising:

a side hole bored through said lower section of each metal segment into said cooling fluid conduit;

a groove disposed around each of said side holes and adapted to receive an O-ring; and a cooling pipe fixed to said metal segment for communicating said cooling fluid to or from said cooling fluid conduit said side hole, wherein a cooling fluid circuit is formed after said upper and lower induction coils are installed on said crucible.

10. The levitation melting furnace of claim 1, further comprising:

a side hole bored through said upper section of each segment into said cooling fluid conduit;

a groove disposed around each of said side holes and adapted to receive an O-ring; and a cooling pipe fixed to said metal segment for communicating said cooling fluid to or from said cooling fluid conduit via said side hole, wherein a cooling fluid circuit is formed after said upper and lower induction coils are installed on said crucible.

* * * * *

UNITED STATES PATENT AND TRADEMARK OFFICE

CERTIFICATE OF CORRECTION

PATENT NO. : 5,889,813

DATED : March 30, 1999

INVENTOR(S) : Fujita et al.

It is certified that error appears in the above-identified patent and that said Letters Patent is hereby corrected as shown below:

Column 8, Line 3, Claim 9, after "conduit" insert --via--.

Signed and Sealed this

Twenty-fourth Day of August, 1999

*Attest:*

Q. TODD DICKINSON

*Attesting Officer*

*Acting Commissioner of Patents and Trademarks*